US011127258B2

(12) United States Patent
Nelson et al.

(10) Patent No.: US 11,127,258 B2
(45) Date of Patent: Sep. 21, 2021

(54) LOTTERY GAMING SYSTEM AND METHOD FOR OPERATING A LOTTERY GAMING SYSTEM

(71) Applicant: IGT GLOBAL SOLUTIONS CORPORATION, Providence, RI (US)

(72) Inventors: Dwayne Nelson, Las Vegas, NV (US); Patrick Danielson, Las Vegas, NV (US); Cameron Filipour, Las Vegas, NV (US)

(73) Assignee: IGT GLOBAL SOLUTIONS CORPORATION, Providence, RI (US)

( * ) Notice: Subject to any disclaimer, the term of this patent is extended or adjusted under 35 U.S.C. 154(b) by 0 days.

(21) Appl. No.: 16/537,082

(22) Filed: Aug. 9, 2019

(65) Prior Publication Data

US 2021/0043030 A1 Feb. 11, 2021

(51) Int. Cl.
*G07F 17/32* (2006.01)

(52) U.S. Cl.
CPC ..... *G07F 17/329* (2013.01); *G07F 17/3244* (2013.01)

(58) Field of Classification Search
CPC ..... G07F 17/329; G07F 17/3244
See application file for complete search history.

(56) References Cited

U.S. PATENT DOCUMENTS

| | | | | |
|---|---|---|---|---|
| 5,788,573 | A * | 8/1998 | Baerlocher | G07F 17/32 273/138.2 |
| 7,682,240 | B2 | 3/2010 | Tulley et al. | |
| 8,491,372 | B2 | 7/2013 | Walker et al. | |
| 9,652,940 | B1 | 5/2017 | Matturro | |
| 2006/0223617 | A1* | 10/2006 | Tulley | G06Q 30/0283 463/17 |
| 2007/0105612 | A1* | 5/2007 | Fotevski | A63F 3/08 463/16 |
| 2009/0264176 | A1* | 10/2009 | Walker | G07F 17/3223 463/17 |
| 2012/0071222 | A1 | 3/2012 | Burks et al. | |
| 2012/0299241 | A1* | 11/2012 | Frick | G06Q 50/34 273/139 |
| 2017/0113127 | A1* | 4/2017 | Hoover | G07F 17/3272 |

* cited by examiner

*Primary Examiner* — Milap Shah
*Assistant Examiner* — Thomas H Henry
(74) *Attorney, Agent, or Firm* — Neal, Gerber & Eisenberg LLP

(57) ABSTRACT

A lottery gaming system and method providing a lottery game that enables a player to obtain a unique player set of symbols for a lottery ticket for a play of a lottery game. In various embodiments, the lottery gaming system and method enables the player to originally purchase the lottery ticket with a unique player set of symbols for the play of the lottery game. In various other embodiments, the lottery gaming system and method enables the player to change one or more of the symbols of player set of symbols of a lottery ticket for a play of the lottery game that the player previously purchased to obtain a replacement lottery ticket with a different player set of symbols (such as a unique player set of symbols) for that play of the lottery game.

19 Claims, 4 Drawing Sheets

300

LOTTERY GAMING SYSTEM AND METHOD FOR OPERATING A LOTTERY GAMING SYSTEM

BACKGROUND

The present disclosure relates to lottery gaming systems and methods, and more particularly to lottery gaming systems and methods that enable the play of lottery games. Certain lottery gaming systems may enable a player to select a plurality of player numbers for a lottery ticket (or cause a random selection of a plurality of player numbers for a lottery ticket), randomly select a plurality of winning draw numbers, and if the winning draw numbers match the player numbers, provide the player an award. Various such lottery gaming systems may enable multiple players to select the same numbers for a play of a lottery game. Various such lottery gaming systems require players with the same winning numbers for a play of a lottery game to share the award associated with those winning numbers.

BRIEF SUMMARY

In various embodiments, the present disclosure provides a lottery gaming system including a processor and a memory device that stores a plurality of instructions, that when executed by the processor, cause the processor to: in association with receipt of a lottery ticket wager for a play of a lottery game, select a first quantity of symbols from a plurality of different symbols to determine a unique player set of symbols for the play of the lottery game, the first quantity of symbols being more than one; generate a lottery ticket including an indication of the unique player set of symbols; and store data associated with the lottery ticket. The plurality of instructions, when executed by the processor, further cause the processor to prevent any other lottery ticket for the play of the lottery game from having the unique player set of symbols. The plurality of instructions, when executed by the processor, further cause the processor to: at a designated draw time for the play of the lottery game, randomly select a plurality of winning draw symbols for the play of the lottery game; and responsive to receipt of the lottery ticket for redemption, determine any award associated with the lottery ticket, the determination based on how many symbols of the unique player set of symbols match the winning draw symbols.

In various embodiments, the present disclosure provides a lottery gaming system including a processor and a memory device that stores a plurality of instructions, that when executed by the processor, cause the processor to: in association with receipt of a lottery ticket wager for a play of a lottery game, select a first quantity of symbols from a plurality of different symbols to determine a player set of symbols for the play of the lottery game, the first quantity of symbols being more than one; generate a lottery ticket including an indication of the player set of symbols; and store data associated with the lottery ticket. The plurality of instructions, when executed by the processor, further cause the processor to: before a draw for the play of the lottery game, responsive to receipt of a change symbol request for the lottery ticket, change one of the first quantity of symbols to form a modified player set of symbols for the lottery ticket for the play of the lottery game; generate a modified lottery ticket including an indication of the modified player set of symbols; and store data associated with the modified lottery ticket. The plurality of instructions, when executed by the processor, further cause the processor to: at a designated draw time for the play of the lottery game, randomly select a plurality of winning draw symbols for the play of the lottery game; and responsive to receipt of the modified lottery ticket for redemption, determine any award associated with the modified lottery ticket, the determination based on how many symbols of the modified player set of symbols match the winning draw symbols.

In various embodiments, the present disclosure provides a method of operating a gaming system, the method including: in association with receipt of a lottery ticket wager for a play of a lottery game, selecting a first quantity of symbols from a plurality of different symbols to determine a unique player set of symbols for the play of the lottery game, the first quantity of symbols being more than one; generating a lottery ticket including an indication of the unique player set of symbols; and storing data associated with the lottery ticket. The method further includes preventing any other lottery ticket for the play of the lottery game from having the unique player set of symbols. The method further includes at a designated draw time for the play of the lottery game, randomly selecting a plurality of winning draw symbols for the play of the lottery game; and responsive to receipt of the lottery ticket for redemption, determining any award associated with the lottery ticket, the determination based on how many symbols of the unique player set of symbols match the winning draw symbols.

Additional features are described in, and will be apparent from, the following Detailed Description and the figures.

DETAILED DESCRIPTION

In various embodiments, the present disclosure relates generally to a lottery gaming system and a method of operating a lottery gaming system that enables a player to obtain one or more unique player sets of symbols for one or more lottery tickets for one or more plays of one or more lottery games. In various embodiments, the lottery gaming system and method enables the player to originally purchase the lottery ticket with a unique player set of symbols for the play of the lottery game. In various other embodiments, the lottery gaming system and method enables the player to change one or more of the symbols of player set of symbols of a lottery ticket for a play of the lottery game that the player previously purchased to obtain a replacement lottery ticket with a different player set of symbols (such as a unique player set of symbols) for that play of the lottery game.

Figure 1:
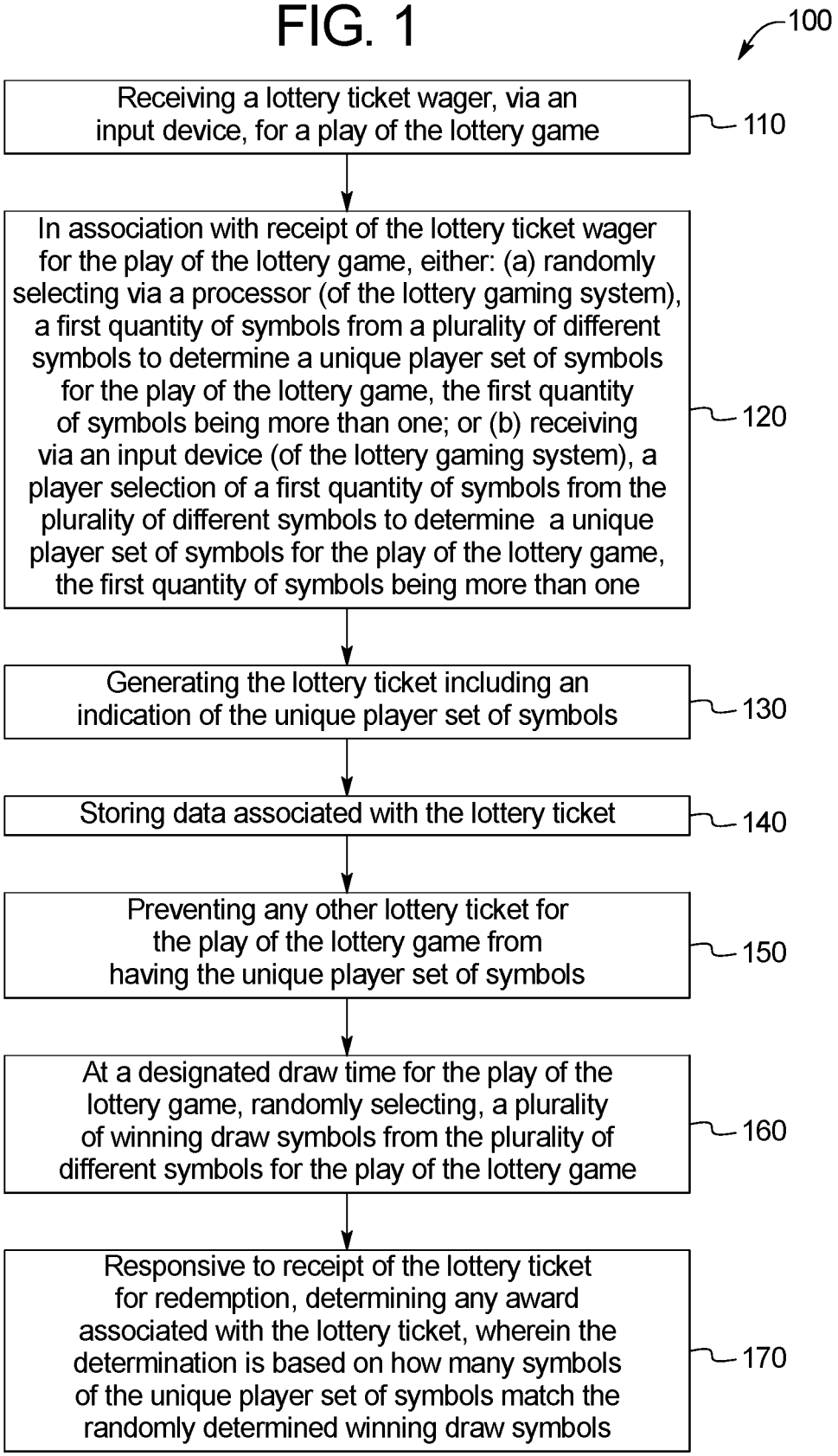
FIG. 1 is a flowchart of an example method for operating a lottery gaming system of one example embodiment of the present disclosure.

FIG. 1 is a flowchart of an example method (indicated by numeral 100) of operating a lottery gaming system of the present disclosure. In various embodiments, the method is represented by a set of instructions stored in one or more memory devices and executed by one or more processors. Although the method is described with reference to the flowchart shown in FIG. 1, many other processes of performing the acts associated with this illustrated example method may be employed. For example, the order of certain of the illustrated blocks may be changed, certain of the illustrated blocks may be optional, or certain of the illustrated blocks may not be employed. It should be appreciated, that when applicable, the terms "a" or "an" include one or more throughout this disclosure.

In the example embodiment illustrated in FIG. 1, the method 100 includes the lottery gaming system: (1) receiving a lottery ticket wager, via an input device, for a play of the lottery game, as indicated by block 110; and (2) in association with receipt of the lottery ticket wager for the play of the lottery game, either: (a) randomly selecting via a processor (of the lottery gaming system), a first quantity of symbols from a plurality of different symbols to determine a unique player set of symbols for the play of the lottery game, the first quantity of symbols being more than one; or (b) receiving via an input device (of the lottery gaming system), a player selection of a first quantity of symbols from the plurality of different symbols to determine a unique player set of symbols for the play of the lottery game, the first quantity of symbols being more than one, as indicated by block 120.

It should be appreciated that the plurality of different symbols can be any suitable different symbols. In various example embodiments of the present disclosure, the plurality of different symbols are a plurality of different numbers (such as but not limited to the following example groups of different numbers: 1 to 5, 1 to 10, 1 to 20, 1 to 30, 1 to 40, 1 to 50, 1 to 60, etc.). In various embodiments, the lottery game is a multi-symbol matching type of lottery game where the player has a plurality of different numbers and any award is determined based on the quantity of matches of such player numbers and randomly determined winning draw numbers. Examples of such lottery games include but are not limited to the following well known lottery games: the LOTTO® game, the MEGA MILLIONS® game, and the POWERBALL® game.

It should be appreciated that the total quantity of possible unique player sets of symbols that are available for players to obtain (and thus excluded other players from obtaining) for a play of a lottery game can be: (1) predetermined for one or more or each play of a lottery game; (2) randomly determined for one or more or each play of the lottery game; or (3) otherwise suitably determined based on one or more factors for one or more or each play of a lottery game (such as but not limited to being based on the quantity of different symbols, based on the wager level, based on player status, based on quantity of plays of the lottery game purchased). In various embodiments, two or more of the unique player sets of symbols can be grouped together and accessible upon certain conditions or for certain groups of players. For instance, a gold level ticket can be unique to a single player and costs more than a silver level ticket that can be unique to two players.

It should be appreciated that the available unique player sets of symbols can be selected in any one of a plurality of different suitable manners in accordance with the present disclosure. In other words, which of the different symbols that form each of the determined quantity of unique player sets of symbols for a play of a lottery game can be: (1) predetermined for one or more or each play of a lottery game; (2) randomly determined for one or more or each play of the lottery game; or (3) otherwise suitably determined for one or more or each play of a lottery game.

In various example embodiments, the lottery gaming system determines one or more unique player sets of symbols that are available for players for a play of the lottery game before enabling lottery tickets to be purchased for that play of the lottery game. For instance, in the simple example using the numbers 1 to 5 as the group of different symbols, there are 10 unique combinations of the combination of two different numbers (e.g., 5 & 4; 5 & 3; 5 & 2; 5 & 1; 4 & 3; 4 & 2; 4 & 1; 3 & 2; 3 & 1; and 2 & 1)). For this simple example, the order of selection does not matter. The lottery gaming system can determine one, a plurality, or all of these unique combinations to each be obtainable for a single lottery ticket for a play of the game. For instance, the lottery gaming system can determine that only the first four of these ten unique sets of numbers (i.e., 5 & 4; 5 & 3; 5 & 2; and 5 & 1) will be each reserved for a single lottery ticket for a play of the lottery game. In other words, in this example, the lottery gaming system will allow four of the ten different possible lottery tickets for a play of the lottery game to each include a different one of these unique player sets of numbers (e.g., only 1 lottery ticket with the numbers 5 & 4; only 1 lottery ticket with the numbers 5 & 3; only 1 lottery ticket with the numbers 5 & 2; and only 1 lottery ticket with the numbers 5 & 1). In this example, only these four of the ten different possible lottery tickets for the play of the lottery game will be unique and thus there is a limited quantity of unique lottery tickets and unique player sets of numbers for this play of this lottery game. In this example, the lottery gaming system can issue one or more lottery tickets with any of the other six number combinations (i.e., any of 4 & 3; 4 & 2; 4 & 1; 3 & 2; 3 & 1; and 2 & 1). For example, five lottery tickets with the numbers 2 & 1 may be issued by the lottery gaming system. In such an example, if the numbers 2 & 1 are the winning draw numbers, the five players holding those five lottery tickets each with the numbers 2 & 1 will split the award associated with that winning combination of numbers. On the other hand, in this example, since four of the lottery tickets can be unique for this play of this lottery game, if any of the number combinations 5 & 4, 5 & 3, 5 & 2, or 5 & 1 are the winning draw numbers for this play of the lottery game, there is a guarantee that there will be only one winning lottery ticket having that combination of those winning draw numbers and that the player having that lottery ticket with that combination will not have to share the award associated with that winning lottery ticket with any other player.

It should be appreciated that with larger sets of symbols such as numbers from 1 to 80, the quantity of unique player sets of numbers can be significantly larger (such as 100,000 unique player sets of numbers) that enable a relatively large quantity of players to purchase such unique sets and that can substantially increase revenue for a play of a lottery game.

It should also be appreciated that the lottery gaming system can enable players to obtain the lottery tickets with the unique player sets of symbols in any one of a plurality of different manners such as but not limited to the following manners.

In various example embodiments, for a play of the lottery game, the lottery gaming system causes a display (via a suitable display device) of the available (or remaining) unique player sets of symbols for the play of the lottery game, enables a player to specifically select (via a suitable input device) one of the displayed available unique player sets of symbols, and thus enables the player to obtain a lottery ticket having the selected unique player set of symbols for the play of the lottery game. In various such embodiments, the display device and/or the input device are part of or associated with the lottery gaming system. In various other embodiments, the display device and/or the input device are part of a player device such as a player electronic mobile device.

In various other example embodiments, for a play of the lottery game, the lottery gaming system does not cause a display of the available (or remaining) unique player sets of symbols for that play of the lottery game, but enables a player to make or cause an input (via a suitable input device) to indicate that the player wants one of the available unique player sets of symbols. In such case, the lottery gaming system chooses one of the available unique player sets of symbols for the lottery ticket for the player for the play of the lottery game. It should be appreciated that the lottery gaming system can select one of the available unique player sets of symbols for the lottery ticket for the player for the play of the lottery game in a random manner, based on a que (i.e., the next available unique set), or in any other suitable manner in accordance with the present disclosure. In various such embodiments, the input device is part of or associated with the lottery gaming system or the input device is part of a player device such as a player electronic mobile device.

In various other example embodiments, for a play of the lottery game, the lottery gaming system enables a player to select a set of symbols for that play of the lottery game such as by making or causing an input (via a suitable input device) to indicate that the player wants a specific symbols. In such case, the lottery gaming system determines if the player has selected symbols that form one of the available unique player sets of symbols for the lottery ticket for the play of the lottery game. Responsive to a determination that the player has selected symbols that form one of the available unique player sets of symbols for the lottery ticket for the play of the lottery game, the lottery gaming system generates that lottery ticket for the player. Responsive to a determination that the player has not selected symbols that form one of the available unique player sets of symbols for the lottery ticket for the play of the lottery game, the lottery gaming system can inform the player and can either enable the player to change one or more of the selected symbols or can change or suggest to the player a change to one or more of the numbers itself. Thus, in various embodiments, selecting the player symbols includes receiving of a first player selection of a first quantity of symbols, displaying of an indication that the selected first quantity of symbols is not unique, and receiving a second player selection to form a unique player set of symbols for the play of the lottery game. In certain such embodiments, the gaming system can provide additional information to the player to enable the player to make the decision on whether or not to change one of the player symbols. The addition information can include but is not limited to: (a) historical probability information regarding how many times a symbol has been randomly selected as a drawn symbol; (b) historical player symbol selection information regarding the player's historical selection of the symbol; and/or (c) information regarding how many other lottery tickets include one or more of the symbols.

In various different embodiments, the purchase or selection of the lottery tickets with the unique player sets of player tickets can be: (1) on a first come first served basis (until there are no remaining available unique player sets of symbols); (2) for an additional or higher wager amount or fee; (3) for a higher level player (such as based on a player tracking system); (4) based on any other single factor; or (5) based on a suitable combination of factors.

Turning now back to FIG. 1, the method 100 further includes: (3) generating the lottery ticket including an indication of the unique player set of symbols, as indicated by block 130; and (4) storing data associated with the lottery ticket, as indicated by block 140. In various embodiments, the data (including the unique player set of numbers) is stored in a database of the lottery gaming system. In various embodiments, the method includes causing the lottery ticket to be provided to the player, such as by, but not limited to, providing a physical lottery ticket to the player or providing a virtual lottery ticket to a player device (such as a player electronic mobile device).

The method further includes: (5) preventing any other lottery ticket for the play of the lottery game from having the unique player set of symbols, as indicated by block 150. It should be appreciated that this can be done in any suitable manner by the lottery gaming system. It should also be appreciated that in alternative embodiments, the uniqueness of the symbols for a lottery ticket may be of a sub-set of the symbols. For example, the uniqueness may apply to 4 of the 5 symbols (instead of all five of the symbols).

The method 100 further includes: (6) at a designated draw time for the play of the lottery game, randomly selecting a plurality of winning draw symbols from the plurality of different symbols for the play of the lottery game, as indicated by block 160. It should be appreciated that the winning draw symbols can be selected in any suitable manner in accordance with the present disclosure. In various embodiments, the lottery gaming system makes separate random determinations for the winning draw symbols in accordance with the odds of selecting such symbols. In other words, the lottery gaming system independently randomly selects each one of the different symbols to form the winning draw symbols. Thus, the random selection is in accordance with predetermined odds of randomly selecting each of that plurality of different symbols. In various embodiments, the odds for each selection are equal (i.e., one in total quantity of different symbols). It should be appreciated that in other embodiments of the present disclosure, the odds may vary. In certain such embodiments, the odds of selection associated with one or more of the symbols of one or more of the unique set of symbols is higher or lower. In certain such embodiments, the odds of selection associated with one or more of the symbols not in one or more of the unique set of symbols is higher or lower.

The method 100 further includes: (7) responsive to receipt of the lottery ticket for redemption, determining any award associated with the lottery ticket, wherein the determination is based on how many symbols of the unique player set of symbols match the randomly determined winning draw symbols, as indicated by block 170. The lottery gaming system causes the determined award to be provided to the player. It should be appreciated that the determination of any award can be made in any one or multiple different manners for determining awards associated with such multi-symbol lottery type games.

It should be appreciated that the lottery game can have a paytable that is the same as a paytable without the feature of the unique sets of symbols, or that the paytable can take into account the feature of the unique sets of symbols. In various embodiments, the paytable is better for the unique lottery ticket if the player has paid more for the unique lottery ticket. For example, if the player has paid double for the unique lottery ticket, the awards of the paytable can be doubled.

Figure 2:
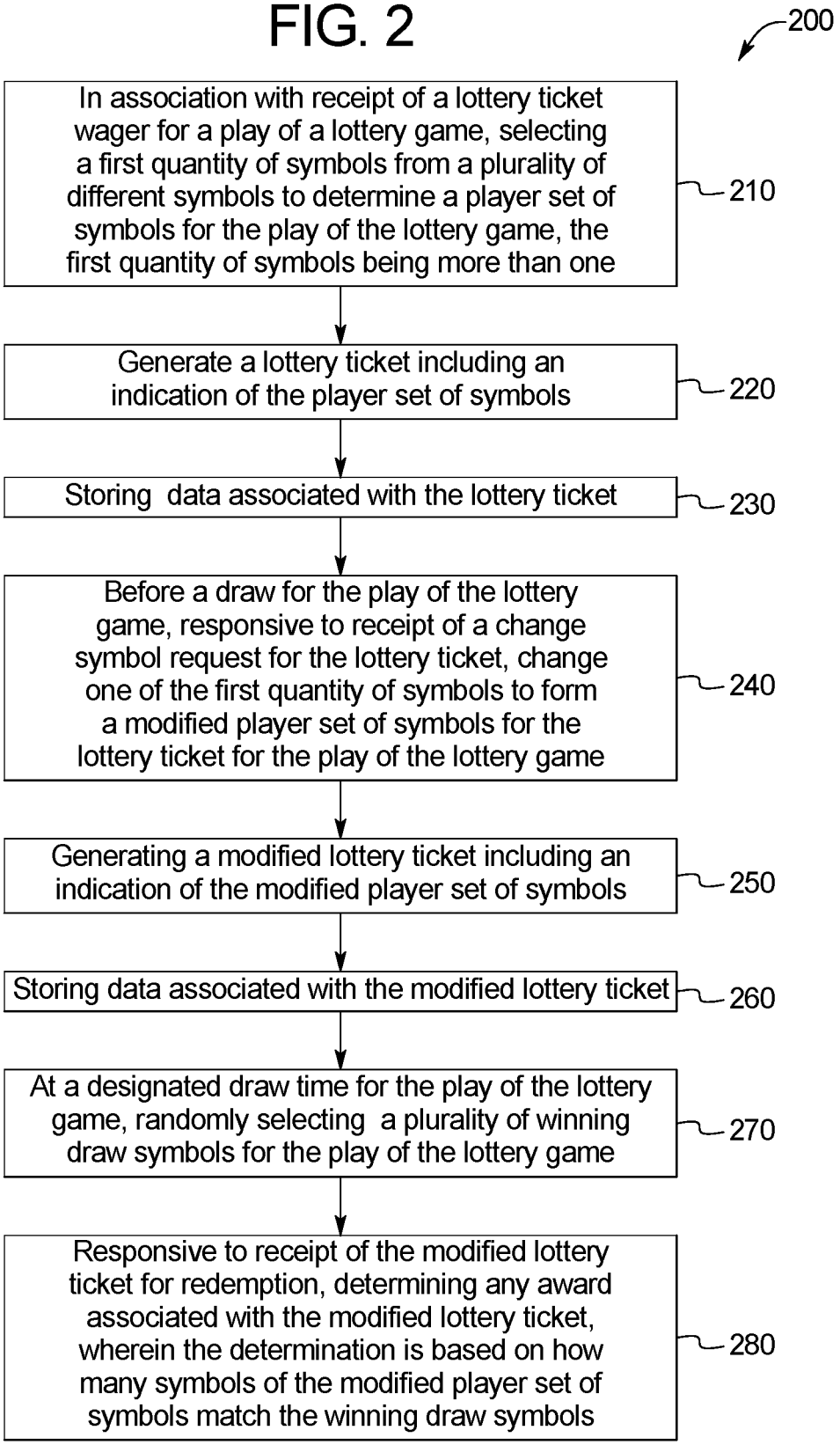
FIG. 2 is a flowchart of another example method for operating a lottery gaming system of another example embodiment of the present disclosure.

FIG. 2 is a flowchart of another example method (indicated by numeral 200) of operating a lottery gaming system of the present disclosure. In various embodiments, the method is represented by a set of instructions stored in one or more memory devices and executed by one or more processors. Although the method is described with reference to the flowchart shown in FIG. 2, many other processes of performing the acts associated with this illustrated example method may be employed. For example, the order of certain of the illustrated blocks may be changed, certain of the illustrated blocks may be optional, or certain of the illustrated blocks may not be employed.

In the example embodiment illustrated in FIG. 2, the method 200 includes the lottery gaming system: (1) in association with receipt of a lottery ticket wager for a play of a lottery game, selecting a first quantity of symbols from a plurality of different symbols to determine a player set of symbols for the play of the lottery game, the first quantity of symbols being more than one, as indicated by block 210; (2) generating a lottery ticket including an indication of the player set of symbols, as indicated by block 220; and (3) storing data associated with the lottery ticket, as indicated by block 230. In various embodiments, the data (including the selected symbols) is stored in a database of the lottery gaming system.

The method 200 further includes: (4) before a draw for the play of the lottery game, responsive to receipt of a change symbol request for the lottery ticket, change one of the first quantity of symbols to form a modified player set of symbols for the lottery ticket for the play of the lottery game, as indicated by block 240.

It should be appreciated that the present disclosure contemplates multiple different reasons why a player may change or want to change one or more of the symbols for their lottery ticket.

In certain embodiments, the lottery gaming system enables a player to change one or more of the first quantity of symbols to form a modified player set of symbols for the lottery ticket for the play of the lottery game at any suitable time before the draw for that play of the lottery game. In certain embodiments, the lottery gaming system enables a player to change one or more of the first quantity of symbols only one time. In certain embodiments, the lottery gaming system enables a player to change one or more of the first quantity of symbols more than once but up to a limited quantity of times. In certain embodiments, the lottery gaming system enables a player to change one or more of the first quantity of symbols an unlimited quantity of times (before a cut-off time prior to the time when the winning draw symbols will be drawn for that play of the lottery game).

In certain embodiments, the lottery gaming system enables a player to change one or more of the first quantity of symbols without any extra wager or fee. In certain embodiments, the lottery gaming system enables a player to change one or more of the first quantity of symbols but requires the player to pay an extra wager or fee to do so. In certain embodiments, the lottery gaming system enables a player to change one or more of the first quantity of symbols for a first designated quantity of times without any extra wager or fee, and a second designated quantity of times requiring the player to pay an extra wager or fee to do so. Each of such first designated quantity and such second designated quantity can be one or more in various embodiments.

In certain embodiments, the lottery gaming system causes a display device to display an indication to the player that the player set of symbols of the player's lottery ticket for the play of the lottery game is not unique. In various embodiments, the lottery gaming system can provide this indication to the player at any suitable time prior to receipt of the change symbol request for the lottery ticket.

For example, in various such embodiments, the lottery gaming system provides the player information regarding the symbols or symbols sets of one or more lottery tickets for the play of the lottery game that have been obtained by one or more other players to indicate to the player whether the player's lottery ticket has a unique set of symbols for the play of the lottery game. In various embodiments, the lottery gaming system does this at determined or designated times or intervals. In various embodiments, the lottery gaming system does this on a real time basis. This information enables a player to decide if the player wants to change the set of symbols of their lottery ticket for the play of the game to a different set of symbols such as to a unique set of symbols for that play of the lottery game. It should be appreciated that the lottery gaming system can provide this information to the player in any suitable manner such as by a notification to the player's electronic mobile device.

In various embodiments, the lottery gaming system enables the player to make or cause one or more inputs (via an input device) to change one or more of the symbols of player set of symbols to form a modified player set of symbols. In various embodiments, the input includes a player selection of one or more of the plurality of different symbols that are not part of the player set of symbols that will become part of the player set of symbols for the modified lottery ticket for the play of the lottery game. In various embodiments, the lottery gaming system displays one or more player selectable symbols that can cause the modified lottery ticket to include a unique set of symbols (that are not at that point selected for any other lottery ticket for the play of the lottery game). In various embodiments, the lottery gaming system displays one or more player selectable symbols that will cause the modified lottery ticket to include a unique set of symbols (and that the lottery system will make unavailable for selection for any other lottery ticket for the play of the lottery game).

In various embodiments, the player input includes a player direction for the lottery gaming system to select one or more of the plurality of different symbols as replacement symbols that are not part of player set of symbols and that will become part of the player set of symbols for the modified lottery ticket for the play of the lottery game. In various embodiments, the player input includes a player direction for the lottery gaming system to select an entirely new set of a plurality of different symbols as symbols for the modified lottery ticket for the play of the lottery game. In various embodiments, the lottery gaming system selects one or more symbols that cause the modified lottery ticket to include a unique set of symbols (and that are not at that point selected for any other lottery ticket for the play of the lottery game). In various embodiments, the lottery gaming system selects one or more player selectable symbols that will cause the modified lottery ticket to include a unique set of symbols (and that the lottery system will make unavailable for selection for any other lottery ticket for the play of the lottery game).

Thus, it should be appreciated from the above that in various embodiments, the lottery gaming system can be configured to: (1) enable the player to obtain an initial unique set of symbols for a play of the lottery game; (2) indicate to the player that the initial unique set of symbols for the play of the lottery game is no longer unique because another lottery ticket with that set of symbols for that play of the lottery game has been issued; and (3) enable the player to change the initial set of symbols for the play of the lottery game to a new unique set of symbols. In certain embodiments, the lottery gaming system causes the new unique set of symbols for the play of the lottery game to be available for selection for another lottery ticket for that play of the lottery game. In certain other embodiments, the lottery gaming system causes the new unique set of symbols for the play of the lottery game to be unavailable for selection for another lottery ticket for that play of the lottery game. In certain such embodiments, the lottery gaming system requires the player to pay an extra wager or fee to make the new unique player set of symbols for the play of the lottery game to be unavailable for selection for another lottery ticket for that play of the lottery game.

Turning back to FIG. 2, the method 200 further includes: (5) generating a modified lottery ticket including an indication of the modified player set of symbols, as indicated by block 250; and (6) storing data associated with the modified lottery ticket, as indicated by block 260. In various embodiments, the data (including the modified symbols) is stored in a database of the lottery gaming system.

The method further includes: (7) at a designated draw time for the play of the lottery game, randomly selecting a plurality of winning draw symbols for the play of the lottery game, as indicated by block 270. It should be appreciated that the winning draw symbols can be selected in any suitable manner in accordance with the present disclosure.

The method 200 further includes: (8) responsive to receipt of the modified lottery ticket for redemption, determining any award associated with the modified lottery ticket, wherein the determination is based on how many symbols of the modified player set of symbols match the winning draw symbols, as indicated by block 280. It should be appreciated that the determination of any award can be made in any one or multiple different manners for determining awards associated with such multi-symbol lottery type games.

Figure 3:
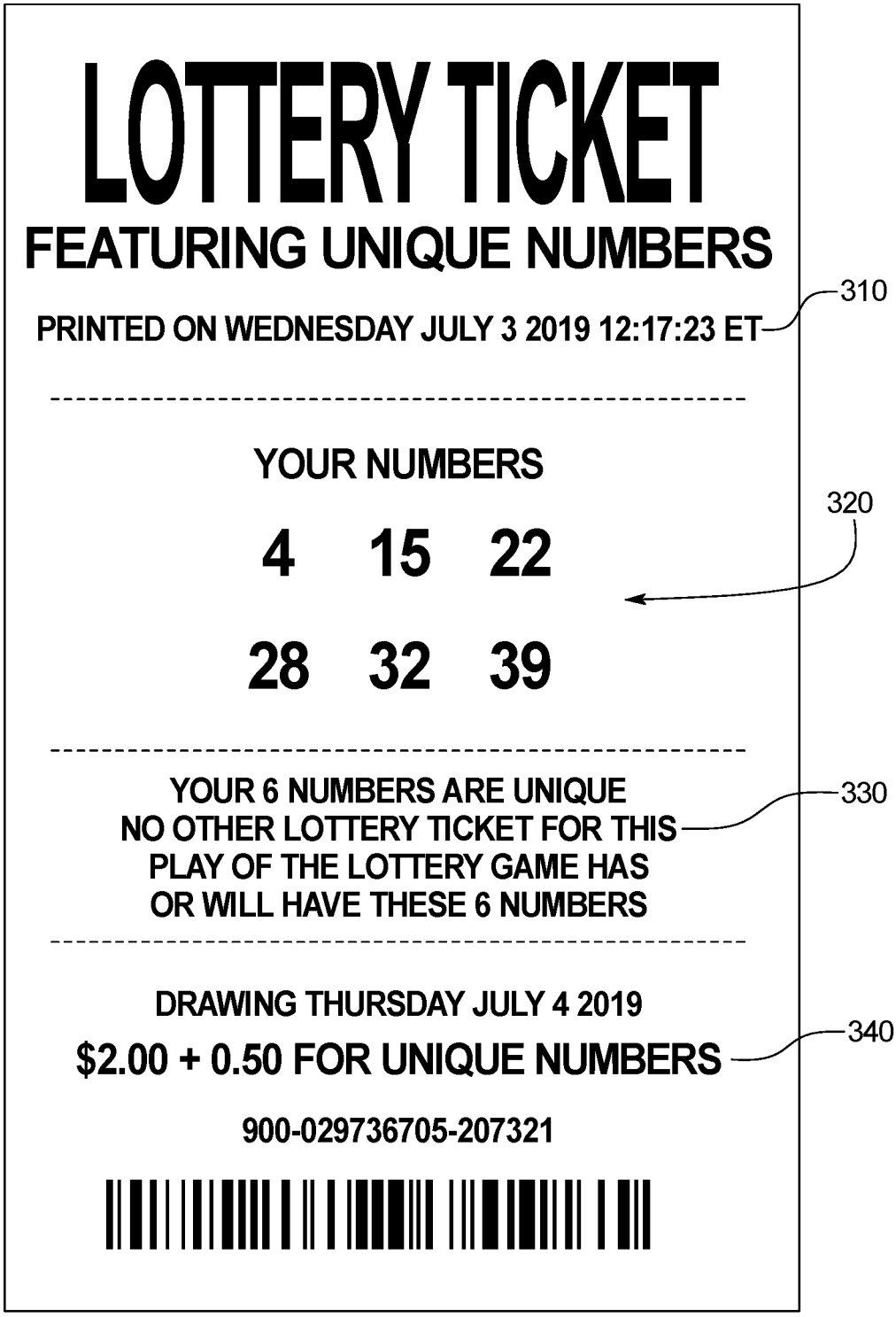
FIG. 3 is a front view of an example lottery ticket provided by one example embodiment of the lottery gaming system of present disclosure.

FIG. 3 shows an example lottery ticket 300 created by an example lottery gaming system of the present disclosure. This example lottery ticket 300 includes: (1) a first lottery ticket information section 310; (2) a player symbol section 320; (3) a unique symbol set indication section 330; and (4) a second lottery ticket information section 340. In the example embodiment, the first lottery ticket information section 310 includes the lottery ticket name and the date and time the lottery ticket was generated and printed. In this example embodiment, the player symbol section 320 includes the unique set of player numbers and an indication that the numbers are the player numbers. In this example embodiment, the unique set indication section 330 includes an indication that the set of player numbers are unique and that no other ticket for the play of the lottery game includes or will include this same unique player set of numbers. In this example embodiment, the second lottery ticket information section 340 includes the amount wagered by the player on the lottery ticket including the extra amount wagered by the player to have a unique player set of numbers, the date of the drawing for the play of the lottery game, and the lottery ticket identification number and barcode. It should be appreciated that the lottery ticket can be alternatively arranged or configured in accordance with the present disclosure. It should be appreciated that any section of the lottery ticket can be alternatively arranged or configured in accordance with the present disclosure.

It should be appreciated from the above that the present disclosure provide an more interactive lottery game and a more interactive lottery gaming system and method—that require additional interaction between the player and the system such as the additional interactions explained above. The systems and methods of the present disclosure thus cause further engagements with the player and thus provide technical advantages over various known lottery gaming systems and methods. Various embodiments of the present disclosure provide a lottery gaming system that enables the players to determine if other players have picked their numbers and thus provides a monitoring feature for players to monitor the lottery ticket selections of other players before the draw. The lottery gaming system and method also facilitates better use of remote player registration and verification procedures for lottery gaming systems due to the expected increased player interaction with the lottery gaming system of the present disclosure.

It should be appreciated that the lottery gaming systems and methods of the present disclosure enable the players that obtain (such as by purchasing) the unique player sets of symbols to have a VIP type status. In various embodiments, the lottery gaming systems and methods of the present disclosure enable the player or facilitate the player in posting such VIP status to social media sites, such as posting that they have one or more unique player sets of symbols and/or what those symbols are. In various embodiments, the lottery gaming systems and methods of the present disclosure enable the player or facilitate the player who has obtained such VIP status to participate in other features of the lottery gaming system such as but not limited to one or more secondary or bonus games that can employ such VIP lottery tickets.

It should also be appreciated that the lottery gaming systems and methods of the present disclosure provide and additional competition for players, depending on the quantity of available unique player sets of symbols or a play of a lottery game.

In various embodiments of the present disclosure, as indicated above, the lottery gaming system and method can enables one or more players to request that the system inform the player when another player obtains a same set of symbols for a lottery ticket as held by the player.

In various embodiments of the present disclosure, the lottery gaming system and method can enable one or more players to reserve one or more unique player sets of symbols for a lottery ticket for one or more future plays of a lottery game. In various such embodiments, the lottery gaming system and method requires the player to pay a fee for reserving such unique player sets of symbols.

In various embodiments of the present disclosure, the lottery gaming system and method can cause a display device to display one or more statistics that are specific to a certain quantity or group of symbols (such as numbers). For example, in various embodiments of the present disclosure, the lottery gaming system and method can cause a display device to display that: (a) 5% of the players for a play of a lottery game have also chose the player's first lottery number, or (b) that there was a large increase in other players picking the players second number for a play of a lottery game (such as the current day's play). The display device may be any suitable display device (including the player's lottery ticket).

In various embodiments of the present disclosure, the lottery gaming system and method can cause a display device to display one or more statistics that are less specific. For example, in various embodiments of the present disclosure, the lottery gaming system and method can cause a display device to display that 500 players have chosen three numbers in common with the player's lottery ticket (such as a lottery ticket with 5 player numbers). In various such embodiments, the lottery gaming system and method may not say which 3 numbers are in common. The display device may be any suitable display device (including the player's lottery ticket).

In various embodiments of the present disclosure, the lottery gaming system and method can cause a display device to display one or more statistics relating to changes in how many players have picked or not picked a symbol (such as a number) overall or in a designated time period (such as in the past day). The display device may be any suitable display device (including the player's lottery ticket).

In various embodiments of the present disclosure, the lottery gaming system and method can cause a display device to display one or more trending statistics (such as the number 5 is increasingly popular for a given play of a lottery game). The display device may be any suitable display device (including the player's lottery ticket).

In various embodiments of the present disclosure, the lottery gaming system and method can assign icons to certain statistical scenarios and can cause a display device to display the icons along with the numbers. For example, in various embodiments of the present disclosure, the lottery gaming system and method can cause a display device to display: (1) a rainbow icon when 5% of the player's share a number; (2) a unicorn when 6% of the people share a number; (3) a heart if no player has one all of the players numbers; and/or (4) a lucky clover when 2 of the 5 numbers haven't been picked by any player. The display device may be any suitable display device (including the player's lottery ticket). Thus, in various such embodiments, a player might look at the player's lottery tickets and see a rainbow, a heart and a unicorn on one lottery ticket but see a heart, lucky clover, gold coin and pot of gold icons on another lottery ticket.

The icons in various embodiments can change over time. For example, as the statistics change, the icons can change. For example, a heart icon can become a lucky clover or a gold coin can become a gold bar.

In various embodiments, the icons can be associated with the ability to change player symbols. For example, the lottery gaming system can show the player symbols as a rainbow, but if the player wants the symbols associated with a unicorn, the gaming system can enable the player to make an input to make such change that will result in the player symbols changing. In such case, the lottery gaming system can determine which player symbols would need to change for the rainbow to become the unicorn and facilitate such change to those player symbols. In certain such cases, the lottery gaming system would require an additional fee from the player. In various embodiments, this can be done at the initial lottery ticket purchase, much like a full or partial quick pick, or at a subsequent time before the draw for that lottery game. In various embodiments, the lottery gaming system can enable the player to pick the icon and then it would randomly pick the player symbols that result in the player picked icon.

In various such embodiments, the lottery gaming system and method can provide the player's or satisfy the player's theories, reasons, or superstitions regarding the player symbols such as the numbers.

In various embodiments, the lottery gaming system and method can include or use the same icons for the same reasons for the winning draw symbols. In such examples, a player might not win but the player may notice that the winning draw symbols had a unicorn and the player may remember that the player had a unicorn originally but then changed the player's lottery numbers. In other such example, a player might notice that many of the recent large awards had a gold coin in them. This may enable the player to build a strategy or theory about how to play the game based on the icons displayed.

In various embodiments, the lottery gaming system and method can keep the rules for mapping statistics to icons over multiple draws so that players can learn the way the icons work.

In various embodiments, the lottery gaming system and method can use icons such as pictures, movies, animations, colors, or any other suitable icons.

It should be appreciated that the unique symbol set feature described above can be employed with any other suitable lottery games in accordance with the present disclosure.

In various embodiments, as further described below, the lottery gaming system and method are configured to be provided by a lottery agency (such as a state lottery agency). In various other embodiments, as further described below, the lottery gaming system and method are configured to be operated by a third party that runs the lottery for a lottery agency (such as a state lottery agency).

In various embodiments of the lottery gaming system, the player may purchase the lottery ticket via any suitable manner. In various embodiments of the lottery gaming system, the lottery ticket is paper. In other embodiments, the lottery ticket is virtual.

In various embodiments of the lottery gaming system, a player may purchase the lottery ticket via any suitable manner such as, but not limited to, one of the following: (1) a dedicated lottery kiosk (e.g., a lottery kiosk) configured to communicate over a data network (such as the Internet) to a lottery server (such as a lottery server 806 described below in connection with FIG. 4); (2) a retailer-operated lottery terminal configured to communicate over a data network (such as the Internet) to a lottery server (such as a lottery server 806 described below in connection with FIG. 4); (3) a personal computer configured to communicate over a data network (such as the Internet) to a lottery server (such as a lottery server 806 described below in connection with FIG. 4); and/or (4) a personal player electronic mobile device (such as a cellular telephone, tablet, or PDA) configured to communicate over a data network (such as a wireless or cellular data network) to a lottery server (such as a lottery server 806 described below in connection with FIG. 4).

In one such example, the lottery gaming system enables a player to purchase a lottery ticket at a retail location having a lottery terminal configured to print the lottery ticket at the time of purchase in a conventional manner. In such lottery gaming systems, the retail operator typically receives the purchase price for the lottery ticket from the player in a conventional manner.

In another such example, the lottery gaming system enables a player to purchase a lottery ticket through a retail lottery kiosk, receive the purchase price from the player, and print the lottery ticket at the time of purchase. This example lottery kiosk may include an integral printer device and/or be in communication with a printer device for providing a printed lottery ticket to the player.

In another such example, the lottery gaming system enables a player to purchase a lottery ticket electronically using a personal electronic mobile device such as the player's mobile telephone. In one such embodiment, the lottery gaming system receives from this device the purchase price from the player, and sends the player a virtual lottery ticket (which in certain instances can be printed by the player using a suitable personal printing device). Thus, it should be appreciated that in various example embodiments, the player may purchase a lottery ticket with a personal mobile device and, thus, may not be provided with a physical (i.e., paper) lottery ticket. Instead, an electronic (or virtual) version of the lottery ticket is provided to the player via, for example, an electronic mail to an email account associated with the player.

In various example embodiments, for each lottery ticket purchased, the lottery gaming system creates a data record corresponding to that lottery ticket. For example, when a lottery terminal is used to purchase a lottery ticket, the lottery gaming system creates a data record including suitable information such as but not limited to: (1) a timestamp (date and/or time) associated with when the lottery ticket was purchased; (2) the player wager level; (3) the selected player numbers; (4) whether the selected player numbers are unique; (5) the lottery ticket identification number; and (6) any other suitable information.

In various example embodiments, this data record is created by the lottery terminal and sent by the lottery terminal to the lottery server (such as described below in connection with the lottery server 806 of FIG. 4). It should be appreciated that the lottery ticket data record can be otherwise suitably created in accordance with the present disclosure.

Example Lottery Gaming Systems—General

As mentioned above, in various embodiments, the lottery gaming system and method of the present disclosure are configured to be operated by a lottery agency (such as a state lottery agency).

As mentioned above, in various other embodiments, the lottery gaming system and method of the present disclosure are configured to be operated by a third party that runs the lottery for a lottery agency (such as a state lottery agency).

Figure 4:
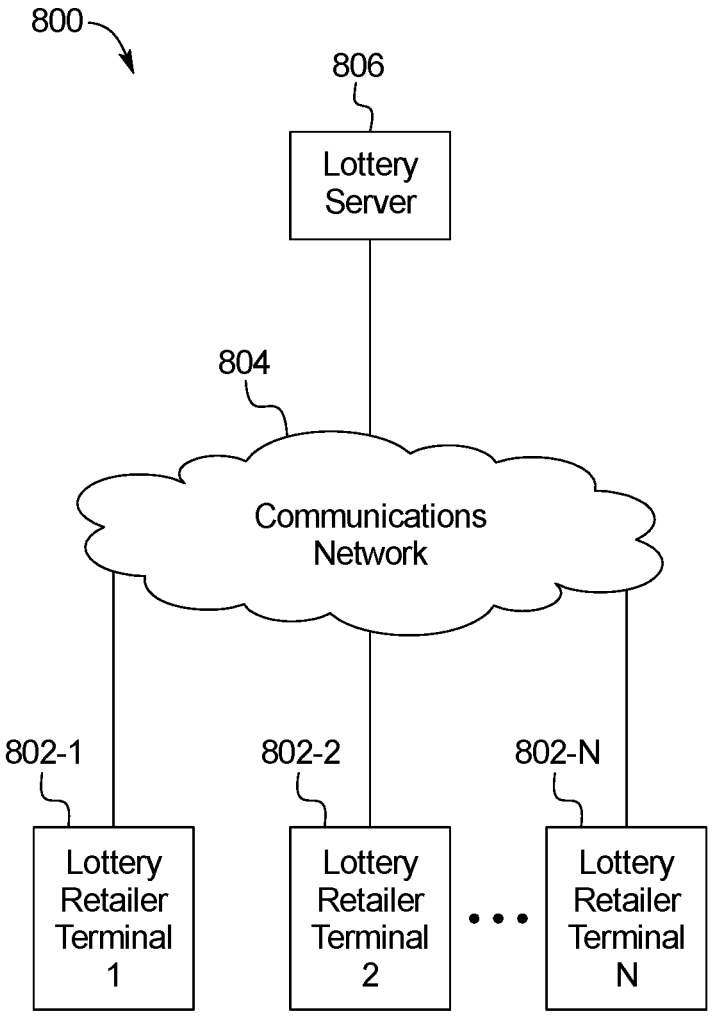
FIG. 4 depicts an example lottery gaming system of one example embodiment of the present disclosure.

FIG. 4 illustrates an example networked lottery gaming system 800 for either such implementation. This example network lottery gaming system 800 generally includes: (1) a plurality of lottery retailer terminals 802-1 to 802-N; (2) a communications network 804; and (3) one or more lottery servers such as lottery server 806. Generally, the retailer terminals 802-1 to 802-N and the lottery server 806 are configured to perform the functions described above and further described below.

In this example embodiment, each retailer terminal 802 corresponds to (or is associated with) a particular lottery retailer. For example, the first retailer terminal 802-1 of FIG. 4 may be associated with a first lottery retailer, such as a convenience store, and the second retailer terminal 802-2 of FIG. 4 may be associated with a second lottery retailer, such as a supermarket. It should be understood that any suitable quantity of lottery retailer terminals may be employed in the lottery gaming system 800, along with any suitable quantity of corresponding lottery servers 806.

In various example embodiments, the lottery retailer terminal 802 includes one or more processor(s). Generally, the processor is operative to perform or process instructions, and in particular, to operate in accordance with the various methods described herein. For example, the processor of the lottery retailer terminal 802 may be operable to enable the lottery retailer terminal 802 to transmit data to (and receive data from) the lottery server 806. More specifically, the processor may enable the transmission of data representing each lottery ticket.

In various example embodiments, the lottery retailer terminal 802 includes one or more input device(s). The input devices of the lottery retailer terminal 802 may include components such as an optical scanner and/or a barcode scanner, for reading and/or for deriving information associated with a playslip and/or a lottery ticket. For example, a lottery ticket may include registration marks, authenticity data, various codes, micro-printed indicia, one or more sense marks, and/or other lottery indicia that must be read. Examples of additional input devices include, but are not limited to, a keypad, a mouse, an image capturing device (e.g., an optical character recognition (OCR) device), a biometric reader, a portable storage device (e.g., a memory stick), and the like.

In various example embodiments, the input device(s) of one or more of the lottery retailer terminals 802 may include a clock. The clock may be employed to detect, derive and/or append time and/or date information for use by the lottery server 806 to: (i) create a data record corresponding to lottery tickets purchased at the lottery retailer terminal 802, (ii) to determine redemption time, round and/or date information associated with lottery tickets, and/or (iii) determine whether a lottery player has redeemed their lottery ticket in a manner that qualifies the player to receive a particular redemption or settlement amount.

In various example embodiments, one or more of the lottery retailer terminals 802 includes one or more output device(s). Such output device(s) may include such components as a display for outputting information to a lottery player or to a terminal operator (e.g., win/loss information and/or payout amounts), one or more benefit output devices (e.g., a cash drawer, a currency dispenser), a printer for producing a physical record (e.g., paper slip, receipt, ticket, voucher, coupon, etc.) that defines a lottery ticket, audio/video output device(s), and the like.

In various example embodiments, one or more of the lottery retailer terminals 802 also includes one or more communications port(s), such as a serial port, a modem or the like. Generally, the communications port of the lottery retailer terminal 802 may be operable to facilitate two-way data communications between (i) the lottery retailer terminal 802, and (ii) the lottery server 806. In accordance with some embodiments, the communications port of the lottery retailer terminal 802 may operate to facilitate the transmission of information between the lottery retailer terminal and a player device such as a personal digital assistant (PDA), cell phone and/or a dedicated (e.g., a proprietary) device.

In various example embodiments, one or more of the lottery retailer terminals 802 includes a data storage device such as a hard disk, optical or magnetic media, random access memory (RAM) and/or read-only memory (ROM), or the like memory device. Generally, the data storage device of the lottery retailer terminal 802 stores a software program, the software program enabling a processor of the retailer terminal 802 to perform various functions including some or all of the various steps described herein. For example, as noted above with respect to FIGS. 1 to 7, in accordance with certain embodiments, the lottery retailer terminal 802 may be configured to perform some or all of the functions of the lottery server 806 (and vice versa) such that the lottery server 806 and the lottery retailer terminal 802 may be considered as the same "device."

In various example embodiments, a lottery sales device may be utilized in place of a lottery retailer terminal 802. Such a lottery sales device may be implemented as a lottery server, a controller, a dedicated hardware circuit, an appropriately programmed general-purpose computer, or any other equivalent electronic, mechanical or electro-mechanical device. Thus, in various embodiments, a lottery sales device may include, for example, but is not limited to: (1) a video lottery terminal that may include a touch sensitive screen for use by a player; (2) a personal computer (e.g., which communicates with a remote lottery server); or (3) a personal mobile device such as a mobile telephone, a tablet, or a personal digital assistant. The lottery sales device may include any or all of the devices of the aforementioned systems.

In this example embodiment, the lottery server 806 operates to: (1) receive and/or store data associated with one or more lottery tickets including such data as: (a) ticket identifier(s), and (b) ticket indicia; (2) determine at least a first redemption amount associated with a lottery ticket; (3) receive a redemption request associated with the lottery ticket; (4) determine a time of play associated with the redemption request; and (5) transmit an indication of the appropriate redemption amount to a lottery retailer terminal (e.g., for output or display to a lottery player and/or lottery terminal operator).

In various example embodiments, the lottery server 806 includes one or more processor(s). Such a processor functions to process instructions, and in particular, to operate in accordance with various methods described herein. For example, the processor may operate to enable the lottery server 806 to transmit data to (and receive data from) the lottery retailer terminal 802. More specifically, the processor of the lottery server 806 may enable the transmission of data representing a lottery ticket, as well as information defining one or more payout(s) associated with that lottery ticket to or by a specific one of the lottery retailer terminals 802 shown in the lottery network 800 of FIG. 4. Thus, the lottery server 806 may be implemented as a system controller, a dedicated hardware circuit, an appropriately and particularly programmed general-purpose computer, or any other equivalent electronic, mechanical or electro-mechanical device capable of providing for one or more of the embodiments described herein.

In various example embodiments, the lottery server 806 includes one or more input device(s). Examples of such input devices include a keypad, a mouse, a touch-screen, a random number generator, a microphone, and other digital or analog input devices.

In various example embodiments, the lottery server 806 also includes one or more output device(s). Example of output device(s) of the lottery server 806 include a monitor or other display for outputting information to an operator of the lottery server 806 (e.g., for displaying information such as statistical or sales data, win and loss information and/or payout amounts), a printer for producing a physical record (e.g., a report) of such data, and the like. In addition, the lottery server 806 may include one or more communications ports, such as a serial port, modem or the like, operable to facilitate two-way data communications between (i) the lottery server 806 and (ii) one or more lottery retailer terminals 802.

In various example embodiments, the lottery server 806 includes a data storage device (e.g., a hard disk or hard drive, a media-based (removable) memory, or the like). In certain embodiments, the data storage device of the lottery server 806 stores at least one software program, which includes a program to enable the processor of the lottery server 806 to perform some or all of the various steps and functions of at least one implementation of the methods described in detail herein. In addition, the data storage device of the lottery server 806 may operate to store one or more databases including a lottery ticket database and a lottery ticket redemption status database.

In various example embodiments, the lottery server 806 includes a lottery ticket server device that is located at a lottery ticket printing facility, and may also function to manage the ticket printing process. The lottery server 806 may also function to develop a lottery game matrix (e.g., determining base payouts, win frequencies, and the like) and to match static lottery content with secure paytable (or payout distribution) data. In certain embodiments, a lottery ticket printer device for use in such lottery gaming systems may utilize the game matrix information from the lottery server and may apply it to the secure paytable data.

In certain example embodiments, a retailer terminal (such as the first retailer terminal 802-1) of FIG. 4 is configured to perform some or all of the functions of the lottery server 806. Thus, in certain example embodiments, the lottery server 806 and the retailer terminal (such as the first retailer terminal 802-1) (or another given retailer terminal and server pairing) may be considered as the same "device."

Generally, the communications network 804 of FIG. 4 includes one or more local and/or wide-area network(s) proprietary and/or public network(s) (e.g., the Internet) for facilitating two-way data communications between the retailer terminals 802 and the lottery server 806. The lottery server 806 may communicate with lottery retailer terminals 802 directly or indirectly, via a wired or wireless medium, such as via the Internet, via a local area network (LAN), via a wide area network (WAN), via an Ethernet, via a Token Ring, via a telephone line, via a cable line, via a radio channel, via an optical communications line, via a satellite communications link, or via any other appropriate communications system or combinations thereof. Any number and type of devices may be in communication with the lottery server 806, and communication between the lottery retailer terminals 802 and the lottery server 806 may be direct or indirect. A variety of communications protocols may be part of any such communications system, including, but not limited to: Ethernet (or IEEE 802.3), SAP, ATP, Bluetooth™, and TCP/IP.

It should be understood that devices in communication with each other need not be continually transmitting to each other. On the contrary, such devices need only transmit to each other as necessary, and may actually refrain from exchanging data most of the time. For example, a device in communication with another device via the Internet may not transmit data to the other device for days or weeks at a time. In some embodiments, a server may not be necessary and/or preferred. For example, in one or more embodiments, methods described herein may be practiced on a stand-alone gaming device and/or a gaming device in communication only with one or more other gaming devices. In such an embodiment, any functions described as performed by the computer may instead be performed by one or more gaming devices.

As used herein, a lottery retailer may include a merchant who sells lottery tickets at a particular location, authenticates winning lottery tickets, redeems authenticated winning lottery tickets, and/or provides awards to players for winning lottery tickets. Examples of various lottery retailers include, but are not limited to, convenience stores, gas stations, supermarkets, and gaming establishments.

Various changes and modifications to the present embodiments described herein will be apparent to those skilled in the art. Such changes and modifications can be made without departing from the spirit and scope of the present subject matter and without diminishing its intended technical scope. It is therefore intended that such changes and modifications be covered by the appended claims.

The invention claimed is:

1. A lottery gaming system comprising:

a processor; and a memory device that stores a plurality of instructions, that when executed by the processor, cause the processor to:

for a play of a lottery game and before enabling a purchase of any lottery tickets for the play of the lottery game, determine a group of unique sets of symbols from a plurality of different symbols for the play of the lottery game, wherein the group of unique sets of symbols comprises at least one set of symbols and less than a total possible quantity of unique sets of symbols that can be formed from the plurality of different symbols;

in association with receipt of a first lottery ticket wager for the play of the lottery game:

cause a display device to display a plurality of the group of unique sets of symbols, cause a selection from the group of unique sets of symbols of one of the plurality of unique sets of symbols to determine a first player set of symbols for the play of the lottery game, generate a first lottery ticket comprising an indication of the first player set of symbols, store data associated with the first lottery ticket, and prevent any other lottery ticket for the play of the lottery game from having the first player set of symbols;

in association with receipt of a second lottery ticket wager for the play of the lottery game:

cause a selection of one of the unique sets of symbols from the different symbols that is not in the group of unique sets of symbols for the play of the lottery game to determine a second player set of symbols for the play of the lottery game and generate a second lottery ticket comprising said selected second player set of symbols, store data associated with the second lottery ticket, and enable any other lottery ticket for the play of the lottery game to also have the second player set of symbols;

at a designated draw time for the play of the lottery game, randomly select a plurality of winning draw symbols for the play of the lottery game; and for each of the first and second lottery tickets, responsive to receipt of the lottery ticket for redemption, determine any award associated with the lottery ticket, the determination based on how many symbols of the player set of symbols match the winning draw symbols.

2. The lottery gaming system of claim 1, for each of the first and second lottery tickets, wherein the lottery ticket is a virtual ticket.

3. The lottery gaming system of claim 1, wherein the selection of one of the plurality of unique sets of symbols comprises receipt of a player selection of the unique set of symbols.

4. The lottery gaming system of claim 1, wherein the selection of one of the plurality of unique sets of symbols comprises receipt of a first player selection of the unique set of symbols, a display of an indication that the selected unique set of symbols is not unique, and receipt of a second player selection to form the unique player set of symbols for the play of the lottery game.

5. The lottery gaming system of claim 1, wherein the play of the lottery game comprises a limited available quantity of the plurality of unique sets of symbols that is less than a total quantity of possible unique sets of symbols based on the plurality of different symbols.

6. The lottery gaming system of claim 1, wherein the first lottery ticket wager for the play of the lottery game for the first unique player set of symbols for the play of the lottery game is more than a lottery ticket wager for a non-unique player set of symbols for the play of the lottery game.

7. A lottery gaming system comprising:

a processor; and a memory device that stores a plurality of instructions, that when executed by the processor, cause the processor to:

in association with receipt of a first lottery ticket wager from a first player for a play of a lottery game, select a first quantity of symbols from a plurality of different symbols to determine a first player set of symbols for the play of the lottery game, the first quantity of symbols being more than one;

generate a first lottery ticket comprising an indication of the first player set of symbols;

after receipt of the first lottery ticket wager, cause the first lottery ticket to be provided to the first player;

store data associated with the first lottery ticket;

in association with receipt of a second lottery ticket wager for the play of the lottery game, select a second quantity of symbols from the plurality of different symbols to determine a second set of symbols for the play of the lottery game;

thereafter, before a draw for the play of the lottery game, cause a display device to display an indication to the first player that the first player set of symbols for the play of the lottery game is no longer unique based on the second set of symbols of the second lottery ticket being the same as the first set of symbols of the first lottery ticket;

responsive to receipt of a change symbol request for the first lottery ticket, change one of the first quantity of symbols to form a modified first player set of symbols for the first lottery ticket for the play of the lottery game;

generate a modified first lottery ticket comprising an indication of the modified first player set of symbols;

store data associated with the modified first lottery ticket;

at a designated draw time for the play of the lottery game, randomly select a plurality of winning draw symbols for the play of the lottery game; and responsive to receipt of the modified first lottery ticket for redemption, determine any award associated with the modified first lottery ticket, the determination based on how many symbols of the modified first player set of symbols match the winning draw symbols.

8. The lottery gaming system of claim 7, wherein the first lottery ticket is a virtual ticket.

9. The lottery gaming system of claim 7, wherein the selection of the first quantity of symbols comprises receipt of a player selection of the first quantity of symbols.

10. The lottery gaming system of claim 9, wherein the change of one of the first quantity of symbols to form the modified first player set of symbols comprises a player selection of one of the plurality of different symbols that are not part of the first player set of symbols for the first lottery ticket for the play of the lottery game.

11. The lottery gaming system of claim 7, wherein the change of one of the first quantity of symbols to form the modified first player set of symbols comprises a player selection of one of the plurality of different symbols that is not part of the first player set of symbols for the first lottery ticket for the play of the lottery game.

12. The lottery gaming system of claim 7, wherein the indication to the player that the first player set of symbols for the play of the lottery game is not unique is generated in a response to another player selecting the first player set of symbols.

13. A method of operating a gaming system, the method comprising:

for play of a lottery game and before enabling a purchase of any lottery tickets for the play of the lottery game, determining a group of unique sets of symbols from a plurality of different symbols for the play of the lottery game, wherein the group of unique sets of symbols comprises at least one set of symbols and less than a total possible quantity of unique sets of symbols that can be formed from the plurality of different symbols;

in association with receipt of a first lottery ticket wager for the play of the lottery game:

displaying a plurality of the group of unique sets of symbols;

selecting from the group of unique sets of symbols one of the plurality of unique sets of symbols to determine a first player set of symbols for the play of the lottery game, generating a first lottery ticket comprising an indication of the first player set of symbols, storing data associated with the first lottery ticket, and preventing any other lottery ticket for the play of the lottery game from having the first player set of symbols;

in association with receipt of a second lottery ticket wager for the play of the lottery game:

selecting one of the unique sets of symbols from the different symbols that is not in the group of unique sets of symbols for the play of the lottery game to determine a second player set of symbols for the play of the lottery game and generating a second lottery ticket comprising said selected second player set of symbols, store data associated with the second lottery ticket and enable any other lottery ticket for the play of the lottery game to also have the second player set of symbols;

at a designated draw time for the play of the lottery game, randomly selecting a plurality of winning draw symbols for the play of the lottery game; and for each of the first and second lottery tickets, responsive to receipt of the lottery ticket for redemption, determining any award associated with the lottery ticket, the determination based on how many symbols of the player set of symbols match the winning draw symbols.

14. The method of claim 13, which, for each of the first and second lottery ticket wagers, comprises receiving the lottery ticket wager, via a mobile device, for the lottery ticket.

15. The method of claim 14, wherein, for each of the first and second lottery tickets, causing the lottery ticket to be provided to the player comprises causing a virtual lottery ticket to be provided to the player.

16. The method of claim 13, wherein, for each of the first and second lottery tickets, causing the lottery ticket to be provided to the player comprises causing a paper lottery ticket to be provided to the player.

17. The method of claim 13, wherein the selecting of one of the plurality of unique sets of symbols comprises receiving of a first player selection of the unique set of symbols, displaying of an indication that the selected unique set of symbols is not unique, and receiving of a second player selection to form the first player set of symbols for the play of the lottery game.

18. The method of claim 13, further comprising displaying, by a display device, a remaining quantity of available unique sets of symbols of the group of unique sets of symbols for the play of the lottery game prior to the selecting of one of the plurality of unique sets of symbols.

19. The method of claim 18, which comprises increasing a lottery ticket wager as the remaining quantity of available unique sets of symbols of the group of unique sets of symbols for the play of the lottery game decreases.

* * * * *